US005692788A

United States Patent [19]

Costa

[11] Patent Number: 5,692,788

[45] Date of Patent: Dec. 2, 1997

[54] ADJUSTABLE LOCKING PLATE FOR A TRUCK OR TRAILER ROLL-UP DOOR

[75] Inventor: John Costa, Gallatin, Tenn.

[73] Assignee: Kargo-Flex of North America, Inc., Nashville, Tenn.

[21] Appl. No.: 587,643

[22] Filed: Jan. 17, 1996

[51] Int. Cl.[6] ..... E05B 15/02

[52] U.S. Cl. ..... 292/341.19; 292/DIG. 60

[58] Field of Search ..... 292/341.19, 341.18, 292/340, DIG. 60

[56] References Cited

U.S. PATENT DOCUMENTS

| | | | |
|---|---|---|---|
| 2,275,760 | 3/1942 | Hoffman | 292/341.19 X |
| 3,161,429 | 12/1964 | Tomue, et al. | 292/341.18 |
| 3,179,458 | 4/1965 | Sconzo | 292/341.18 X |
| 3,245,709 | 4/1966 | Rosenberger | 292/341.18 |
| 3,603,629 | 9/1971 | Windham | 292/145 |
| 3,784,243 | 1/1974 | Pastva, Jr. | 296/50 |
| 4,056,275 | 11/1977 | Keeler, II | 292/341.18 X |
| 4,087,123 | 5/1978 | Redshaw | 292/341.19 |
| 4,113,293 | 9/1978 | Paquette | 292/341.13 |
| 4,305,611 | 12/1981 | Robins | 292/341.19 X |
| 4,451,071 | 5/1984 | Striese et al. | 292/341.18 |
| 4,483,557 | 11/1984 | Pastva | 292/218 |
| 4,941,703 | 7/1990 | Curry | 296/50 |
| 5,118,151 | 6/1992 | Nicholas, Jr. et al. | 292/341.19 |
| 5,127,690 | 7/1992 | Kim et al. | 292/DIG. 60 X |

*Primary Examiner*—Rodney M. Lindsey
*Attorney, Agent, or Firm*—Waddey & Patterson; I. C. Waddey, Jr.

[57] ABSTRACT

An adjustable latch assembly for the lock assembly of a pull-down door used to close a container space such as the cargo bay of a van or van body of a truck or similar vehicle. The adjustable latch assembly includes a face plate designed to be mounted flush with the floor of the truck bed. The face plate has elongated openings on either side thereof for receiving the locking tongue of a lock assembly. The opposing openings are separated by a bridge surface which covers the adjustable latch mechanism of the present invention. The adjustable latch mechanism includes opposing legs protruding from either side of the bridge with a foot on the opposite end of each leg. Each of the legs has an elongated slot that serves as a guide mechanism for the adjustable latch striker extending beneath the bridge and substantially parallel to it. The striker has opposing ends with holes bored through each opposing end. On one end, the hole passes over a guide journal, and the hole on the opposite end is threaded and receives a threaded adjustment bolt. Turning the threads of the bolt will cause the striker to raise or lower depending on the direction of rotation of the adjustment bolt. This allows the striker to be adjusted so that in the event the door fails to seal the cargo area of a van, the adjustment bolt can be turned, lowering the striker and thereby causing a greater downward force to be placed on the door when the tongue of the lock assembly is engaged beneath the striker and pivoted into a locking position. The guides on both sides of the striker hold it in alignment and keep it from jamming or otherwise binding when the striker is adjusted from time to time.

13 Claims, 3 Drawing Sheets

ADJUSTABLE LOCKING PLATE FOR A TRUCK OR TRAILER ROLL-UP DOOR

BACKGROUND OF THE INVENTION

The present invention relates generally to the latch plate or locking plate for the cargo door of a truck, trailer or similar cargo transport product. More specifically, my invention is an adjustable latch plate for the roll-up cargo door in such an application where the cross bar is adjustable and has adequately support and reinforcement to sustain the pressure and abuse that is often experienced in this application.

My invention will be described in conjunction with the latching of a pull-down door on a truck having a van-type cargo body, but it will be appreciated by those skilled in the art that the invention could be employed in a variety of applications, particularly applications related to transport vehicles such as the trailers pulled by tractors commonly referred to as "eighteen wheeler rigs", rail cars, small cargo vans, and the like. However, the most common application for the present invention would be in conjunction with refrigeration trucks because of the desire and necessity of having and maintaining an adequate seal of the cargo door with the frame of the truck at the latching point. Therefore, the present invention will be described in conjunction with that application.

Trucks, and particularly refrigerated trucks having a van-type body are used to haul frozen and refrigerated cargo, particularly food stuffs, for both local delivery and for cross-country transport of such items. A compressor is normally mounted on the vehicle and refrigeration systems well known in the art are provided to maintain a certain desired refrigeration level in the cargo bay of the truck. The cargo bay of the truck will generally have an opening, usually at the rear of the truck, into and out of which the cargo is loaded. A door is mounted in the opening, the most common door being an overhead door mounted on a truck which allows the door to be opened and closed by raising and lowering it along the path of the truck. When closed, the door should be sealed about the perimeter of the opening and particularly at the floor of the bed of cargo bay.

When initially installed, these overhead doors are provided with a latching mechanism in the bed of the cargo bay of the truck and a locking mechanism mounted on the door. When activated, the locking mechanism engages the latching mechanism to draw the bottom of the door against the floor of the cargo bay to seal the bottom of the door against the bed of the truck and prevent loss of coolant from within. Unfortunately, as trucks are used over a number of years and subject to various abuses associated with long trips, being opened and closed an infinite number of times, the impelling of crates and other goods against the hardware of the doors and the like, the latching mechanism of the door may become loose or otherwise displaced and therefore the door, even when properly latched will not adequately seal the cargo bay of the truck.

What is needed, then, is a latching structure that will allow adjustments in the sealing pressure applied to the door of the truck so that even after years of use, the mechanism can be adjusted to assist in sealing the door within the opening to retain refrigeration within the cargo. Such a product should also be sturdy, easy to assemble and able to withstand the many pressures and abuses to which such a device would otherwise be exposed. Such a product is presently lacking in the prior art. Prior art devices that have attempted to address this problem have lacked the stability, strength and simplicity that is needed for an adjustable latch plate. Further, the prior art devices fail to have adequate guiding elements and therefore tend to bind after adjustment. These deficiencies of the prior art are overcome by the present invention.

SUMMARY OF THE INVENTION

Applicant's invention is an adjustable latch assembly for the lock assembly of a pull-down door used to close a container space such as the cargo bay of a van or van body of a truck or similar vehicle. The adjustable latch assembly includes a face plate designed to be mounted flush in the floor frame of the truck bed. The face plate has elongated openings on either side thereof for receiving the locking tongue of a lock assembly. The opposing openings are separated by a bridge surface which covers the adjustable latch mechanism of the present invention. The adjustable latch mechanism includes opposing legs protruding from either side of the bridge with a foot on the opposite end of each leg. Each of the legs has an elongated slot that serves as a guide mechanism for the adjustable latch striker extending beneath the bridge and substantially parallel to it. The striker has opposing ends with holes bored through each opposing end. On one end, the hole passes over a guide journal, and the hole on the opposite end is threaded and receives a threaded adjustment bolt. The threads on the adjustment bolt mate with the threads in the opening through the end of the striker and the adjustment bolt is held between the bridge and the facing foot of the assembly so that as the adjustment bolt is turned via a screw driver or similar instrument, the turning of the threads of the bolt will cause the striker to raise or lower depending on the direction of rotation of the adjustment bolt. This allows the striker to be adjusted so that in the event the door fails to seal the cargo area of a van, the adjustment bolt can be turned, lowering the striker and thereby causing a greater downward force to be placed on the door when the tongue of the lock assembly is engaged beneath the striker and pivoted into a locking position. The guides on both sides of the striker hold it in alignment and keep it from jamming or otherwise binding when the striker is adjusted from time to time. The devices illustrated in the preferred embodiment is easy and simple to manufacture and install as a retrofit to existing latch assemblies and insures a tight fit of the pull-down door of a cargo van.

DESCRIPTION OF THE PREFERRED EMBODIMENT

Figure 2:
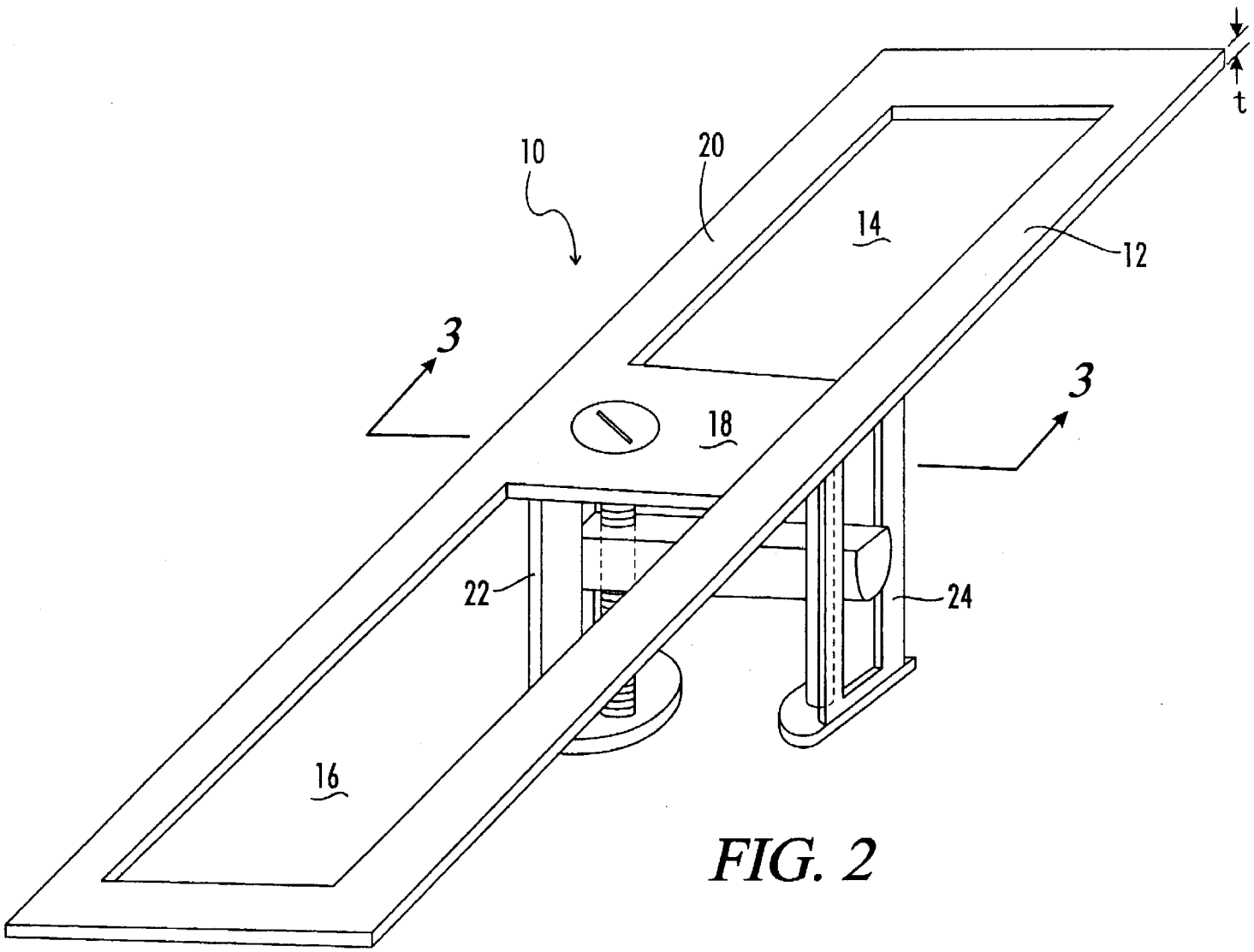
FIG. 2 is a perspective view of the present invention.
Figure 3:
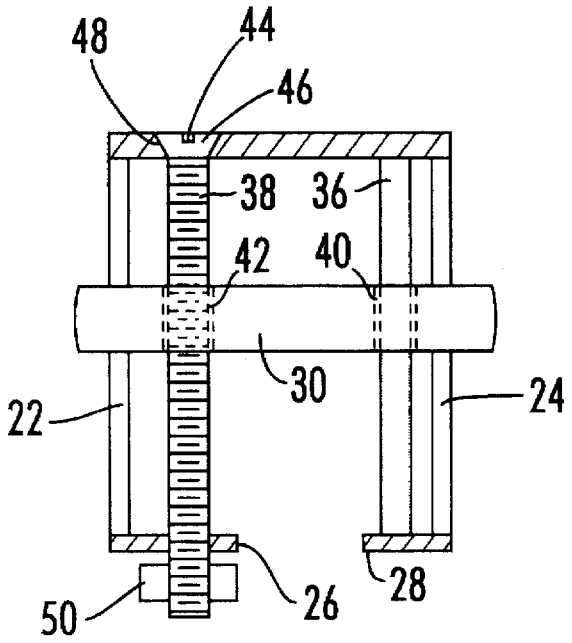
FIG. 3 is a cross sectional view of the present invention taken along the lines 3—3 of FIG. 2.
Figure 4:
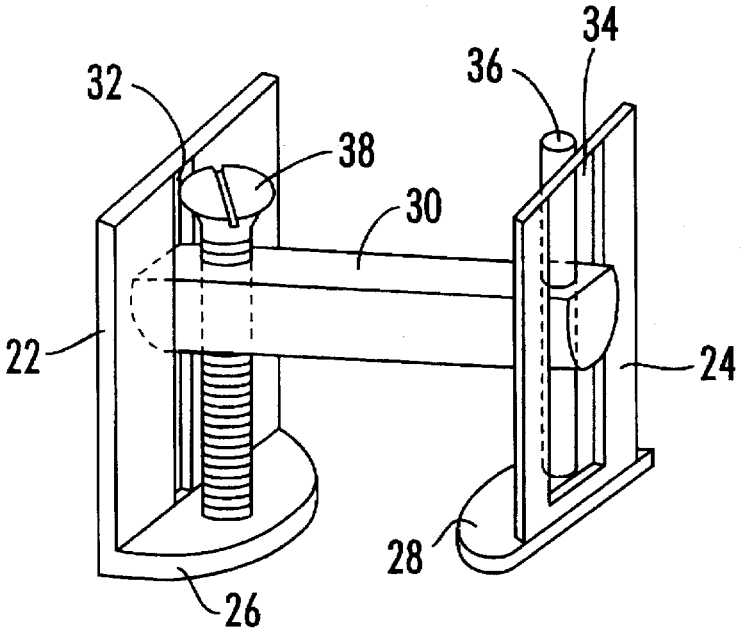
FIG. 4 is a view in perspective of the adjustable assembly mechanism of the adjustable latch device of the present invention with the face plate removed.

The invention will be best understood when consideration is given to the preferred embodiment of the invention as is illustrated in FIGS. 2–4 hereof, considered in conjunction with the description of the preferred embodiment as set forth herein wherein like numerals represent like elements of the invention.

Figure 1:
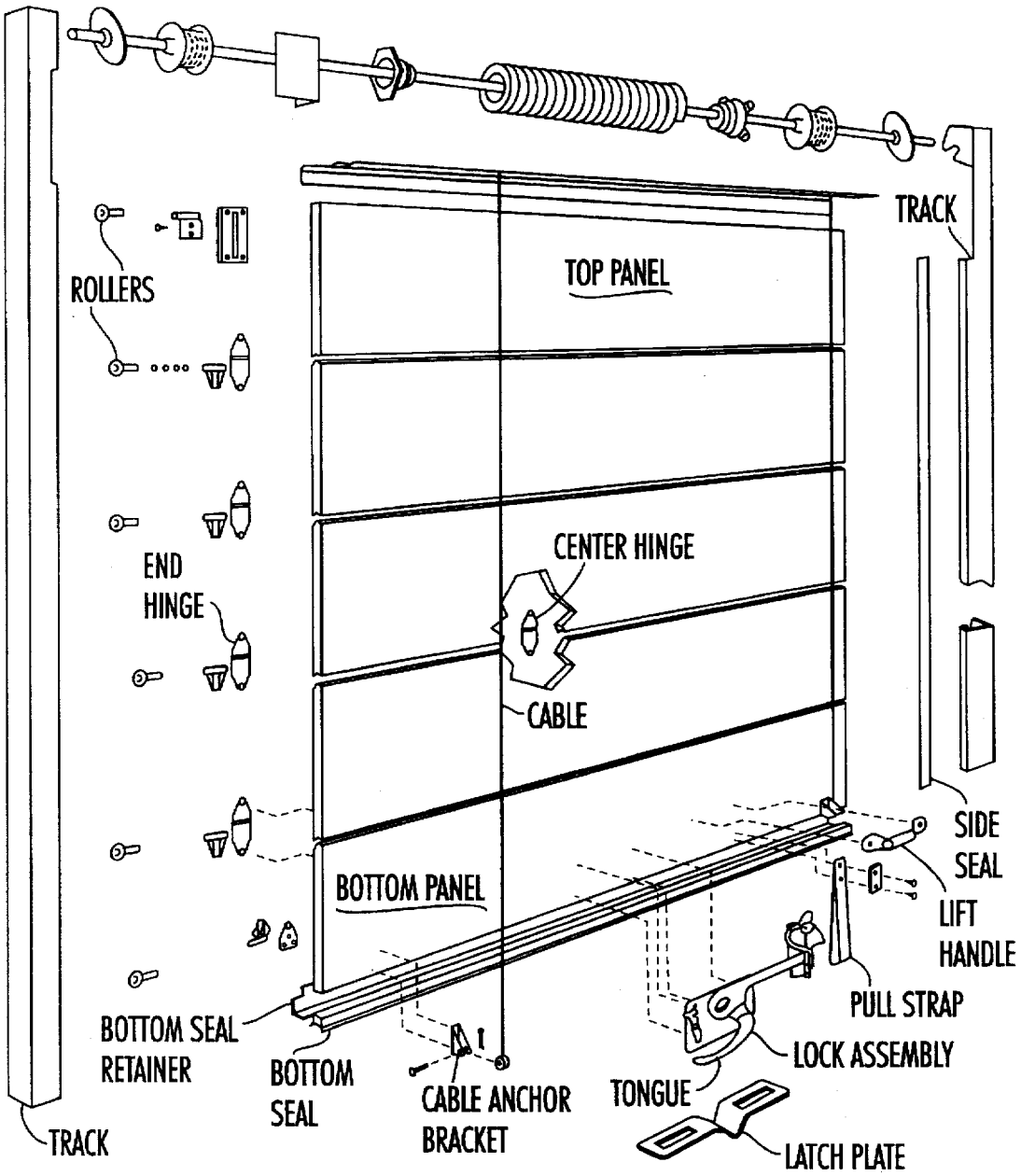
FIG. 1 is an illustration of a prior art pull-down door with lock assembly and latch plate.

Referring first to FIG. 1, a commercially available pull-down door for a van, and its various parts, is illustrated. As can be seen from FIG. 1, the pull-down door consists of multiple panels and has rollers which ride in the trucks mounted within the truck cargo bay. The door includes a bottom seal which is designed to seal the cargo area. One of the primary applications of this invention is on refrigeration trucks where the seal of the door is important to limit loss of refrigeration; however, the latch is also valuable in sealing truck cargo bays hauling dry freight to prevent water from entering the cargo area. The lock assembly as shown in FIG. 1 has a handle which can be rotated to release the lock assembly from the latch plate when the door is to be opened but can be rotated to cause the tongue of the lock assembly to rotate beneath the latch plate and seal the bottom seal of the door against the bed (not shown) of the truck.

The latch plate is flush mounted within the bed of the truck so that the tongue of the lock assembly fits into the cavity surrounding the latch plate and will hold the door securely in place. Of course, after months and years of use, it is possible for the various elements of doors of the type just described to work themselves loose and create "play" at their various points of engagement. This is a particular problem in refrigerated trucks and vans because any excess play will allow gaps to occur between sealing members and cooling to escape.

Referring now to FIGS. 2, 3 and 4, the adjustable latch assembly of Applicant's invention is illustrated generally at 10. The assembly includes a latch plate 12 which has a pair of openings 14, 16 with the openings separated by a bridge 18. The latch plate 12 and the bridge 18 are of a thickness t approximately ¼" which is generally the standard size for the thickness of a prior art latch plate. Thus, the adjustable latch assembly of Applicant's invention can be used to replace the latch plate of the prior art by removing the latch plate of the prior art from a truck and fitting the latch plate assembly of Applicant's invention into the cavity formed in the floor of the truck bed on which the pull-down door is mounted.

The bridge 18 can be integral with the perimeter 20 of the latch plate or it can be formed as a separate element and welded or otherwise affixed to the perimeter.

FIG. 2 illustrates partially, and FIGS. 3 and 4 illustrate in more detail the adjustment mechanism of the adjustable latch assembly of the present invention. The adjustment mechanism includes legs 22 and 24 depending from the latch plate 12. The legs each have a top and a bottom and are connected at their tops to the underside of the outer perimeter of the latch plate 12 and feet 26, 28 protrude from the bottom of each leg. The mechanism is welded to the truck door frame and the legs 22, 24 are sufficiently sturdy to hold the adjustment mechanism in place without having to be affixed to the frame.

The adjustable latch assembly includes the striker 30 which is an elongated bar extending between the opposing legs 22, 24 and protruding through elongated guide slots 32, 34 in the opposing legs 22, 24. Thus, the slots 32, 34 provide a guide truck for the striker 30. The striker 30 is further guided by virtue of the fact that it is journaled on opposing ends over the guide journal 36 and the adjustment bolt 38. The guide journal 36 is fixedly attached at one end to the underside of the bridge 18 and at its opposite end to the upper surface of foot 28. The guide journal 36 is positioned substantially perpendicularly to the striker 30, and a hole 40 extends through one end of the striker 30 with the guide journal 36 passing through the hole 40 to serve as an additional guide structure for the movement of the striker 30.

On the opposite end of the striker 30 there is a threaded hole 42. The threaded hole 42 has passing through it the threaded adjustment bolt 38 with the threads of the adjustment bolt 38 mating with the threads in the threaded hole 42 so that rotation of the adjustment bolt 38 will cause the striker 30 to move either up or down depending on the direction of rotation of the adjustment bolt 38.

The head of the adjustment bolt 38 can be provided with a slot for a flat head screwdriver or some similar slot structure for any known driver mechanism so that the adjustment bolt 38 can be rotated conveniently from the top side of the adjustable latch assembly. The underside of the head 46 of the adjustment bolt is beveled and seats within a beveled hole 48 passing lo through the bridge 18 so that the adjustment bolt 38 can be turned within the hole 48 but will be fixed for movement relative to the plate 18. A lock-nut or other similar known mechanism 50 is welded or otherwise fixed on the end of the adjustment bolt 38 below the foot 26 in order to keep the adjustment bolt 38 in place and fitted flush with the upper surface of the bridge 18. This assembly prevents the head 46 of the adjustment bolt from snapping off as a result of being struck by boxes or other materials being loaded onto the truck.

Because the adjustment bolt 38 is fixed against vertical movement, and because the striker 30 is prevented from rotating upon rotation of the adjustment bolt 38 (the striker 30 being fitted through the slots 32, 34 in the legs 22, 24), any rotation of the adjustment bolt 38 will cause the striker 30 to raise or lower depending upon the direction of rotation of the adjustment bolt.

In operation, once the adjustable latch assembly of the present invention has been installed in a truck bed, the adjustment bolt 38 can be rotated in one direction to raise the striker 30 or in an opposite direction to lower the striker 30 by placing a screwdriver in the slot 44 in the head 46 of the bolt and turning the screwdriver. If the tongue of the lock assembly does not have sufficient pressure on it to hold the bottom seal of the pull-down door flush against the upper surface of the truck bed, the adjustment bolt can be rotated to lower the striker plate 30. When the striker plate 30 is lowered, in order for the tongue of the lock assembly to pass beneath the underside of the striker 30 to latch the pull-down door, the tongue will be lowered thereby placing additional downward pressure on the pull-down door to effectively seal the bottom seal of the door against the upper surface of the truck bed. In the event that the system works loose and has some play sufficient to create a gap between the bottom seal of the pull-down door and the truck gate, further adjustment can be made by simply turning the adjustment bolt 38.

Although there have been described particular embodiments of the present invention of a new and useful Adjustable Locking Plate for a Truck or Trailer Roll-up Door, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. An adjustable latch assembly for installation in the bed of a cargo container, said cargo container having a door designed to open and close and when closed, to seal against the bed of the cargo container, said door having a locking assembly mounted thereon including a locking tongue and means for moving said locking tongue between a locking position and an unlocked position, said adjustable latch assembly including an elongated striker against which said locking tongue is engaged when said locking tongue is in the locking position, said elongated striker having opposing ends, guide means at the opposing ends of said elongated striker for guiding said elongated striker during movement thereof, adjustment means for moving said elongated striker toward and away from said locking tongue whereby the seal of said door against said bed can be adjusted, and further including a latch plate having at least one opening therein and means for mounting said elongated striker beneath said latch plate for movement toward and away from said latch plate.

2. The adjustable latch assembly of claim 1 wherein said guide means includes a journal and said elongated striker includes a journal follower so that movement of said elongated striker is controlled by the movement of said journal follower along said journal.

3. The adjustable latch assembly of claim 1 wherein said guide means include a pair of legs depending from the underside of said latch plate, each said leg having an elongated slot therein with one end of said elongated striker passing through the slot in one of the legs and the other end of said elongated striker passing through the slot in the other leg.

4. The adjustable latch assembly of claim 3 wherein said guide means further includes a journal and said elongated striker includes a journal follower so that movement of said elongated striker is controlled by the movement of said journal follower along said journal.

5. The adjustable latch assembly of claim 4 wherein the journal follower is a hole in one end of the elongated striker and the journal passes through said hole.

6. The adjustable latch assembly of claim 5 wherein said adjustment means includes a threaded hole in one end of said striker and an adjustment bolt passing through said threaded hole whereby rotation of said adjustment bolt will cause said elongated striker to move toward and away from said locking tongue.

7. The adjustable latch assembly of claim 6 wherein said adjustment bolt has a beveled head and the latch plate has a beveled hole for receiving the head of said adjustment bolt whereby the head of the adjustment bolt is flush with the latch plate.

8. The adjustable latch assembly of claim 7 wherein each leg has a free end and further including feet at the free end of each of said legs and a lock-nut fixed to the end of the adjustment bolt opposite the head beneath one of said feet.

9. The adjustable latch assembly of claim 1 wherein said guide means include a pair of legs, each said leg having an elongated slot therein with one end of said elongated striker passing through the slot in one of the legs and the other end of said elongated striker passing through the slot in the other leg.

10. The adjustable latch assembly of claim 9 wherein said guide means further includes a journal and said elongated striker includes a journal follower so that movement of said elongated striker is controlled by the movement of said journal follower along said journal.

11. The adjustable latch assembly of claim 10 wherein the journal follower is a hole in one end of the elongated striker and the journal passes through said hole.

12. The adjustable latch assembly of claim 1 wherein said adjustment means includes a threaded hole in one end of said striker and an adjustment bolt passing through said threaded hole whereby rotation of said adjustment bolt will cause said elongated striker to move toward and away from said locking tongue.

13. The adjustable latch assembly of claim 12 wherein the adjustment bolt includes a beveled head and the latch plate has a beveled hole for receiving the beveled head of said adjustment bolt whereby the head of the adjustment bolt is flush with the latch plate.

* * * * *